US005583520A

United States Patent [19]

Thill

[11] Patent Number: 5,583,520

[45] Date of Patent: Dec. 10, 1996

[54] MATCHED INPUT ANTENNA FOR A PORTABLE RADIO

[75] Inventor: Kevin M. Thill, Kenosha, Wis.

[73] Assignee: Motorola, Inc., Schaumburg, Ill.

[21] Appl. No.: 508,939

[22] Filed: Jul. 28, 1995

[51] Int. Cl.[6] ..... H01Q 1/24

[52] U.S. Cl. ..... 343/702; 343/715; 343/749

[58] Field of Search ..... 343/702, 745, 343/749, 750, 752, 715, 856, 860, 864; H01Q 1/24

[56] References Cited

U.S. PATENT DOCUMENTS

| | | | |
|---|---|---|---|
| 2,709,219 | 5/1955 | Schmidt, Jr. | 343/860 |
| 3,099,010 | 7/1963 | Taylor | 343/749 |
| 4,121,218 | 10/1978 | Irwin et al. | 343/702 |
| 4,137,534 | 1/1979 | Goodnight | 343/752 |
| 4,229,743 | 10/1980 | Vo et al. | 343/749 |
| 4,868,576 | 9/1989 | Johnson, Jr. | 343/702 |
| 5,057,849 | 10/1991 | Dorrie et al. | 343/749 |
| 5,083,136 | 1/1992 | Wells | 343/860 |
| 5,179,387 | 1/1993 | Wells | 343/749 |
| 5,218,372 | 6/1993 | Cheng | 343/749 |
| 5,420,579 | 5/1995 | Urbas et al. | 343/856 |

OTHER PUBLICATIONS

Kraus, J. D., *Antennas,* 1988, 1950, pp. 323–325.

Nakano, H. et al., "Axial Mode Helical Antennas", *IEEE Transactions on Antennas and Propagation,* vol. AP–34, No. 9, Sep. 1986, pp. 1143–1148.

Nakano, H. et al., "Helical Antenna with Increased Power Gain", *IEEE Antennas and Propagation Symposium,* Dec. 8, 1984, pp. 417–420.

*Primary Examiner*—Donald T. Hajec
*Assistant Examiner*—Tan Ho
*Attorney, Agent, or Firm*—Daniel W. Juffernbruch

[57] ABSTRACT

Two coils (10, 20) couple energy to and from an antenna element (30). The lengths of the hot arm coil (10) and the ground arm coil (20) are different to cause a matched input for coupling to the resulting antenna structure. In a portable radio the two coils (10) and (20) efficiently couple to the antenna element (30) without inducing currents on the housing of the portable radio.

15 Claims, 2 Drawing Sheets

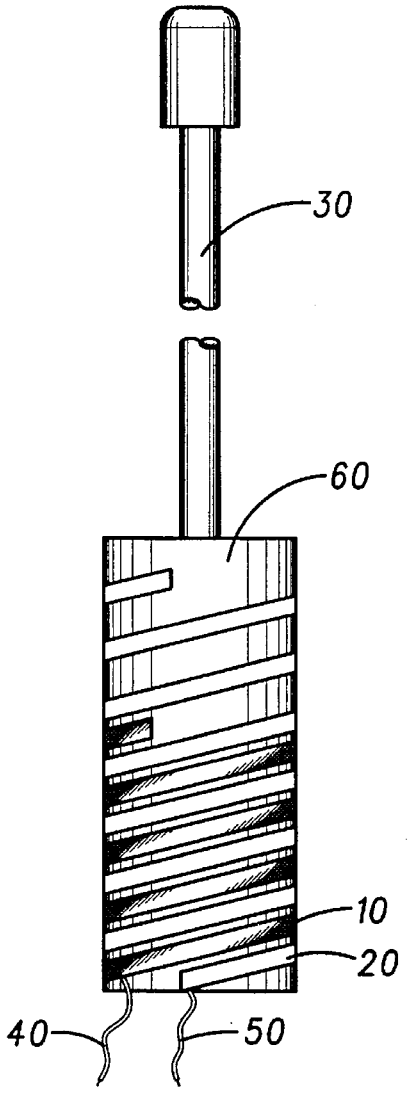
FIG. 1
FIG. 2
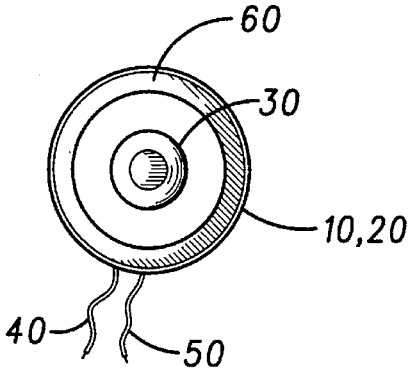

MATCHED INPUT ANTENNA FOR A PORTABLE RADIO

BACKGROUND OF THE INVENTION

1. Technical Field

The present invention relates to impedance matching coupling elements, and more particularly, relates to the structure of an antenna having a matched input.

2. Description of the Related Art

A helical coil is known for capacitively coupling to a half-wavelength monopole radiator. A monopole radiator can be configured by providing a ground plane inside of a portable radio housing. U.S. Pat. Nos. 4,121,218 and 4,868,576 disclose examples of such antennas.

Although the above-described antennas are compact, the coupling of the helical coil to the antenna is lossy, thus consuming unnecessary energy. A lossy antenna structure decreases the battery life of a portable radio. In addition, these antennas also cause energy to be directed downward towards the portable housing. This energy causes induced currents to flow on metalized surfaces or shields of the radio housing which is energy inefficient and degrades the pattern performance of the antenna.

BRIEF DESCRIPTION OF THE DRAWINGS

FIG. 1 illustrates a side view of the matched input antenna structure according to the present invention;

FIG. 2 illustrates an end view of the matched input antenna structure according to the present invention.

DETAILED DESCRIPTION OF THE PREFERRED EMBODIMENTS

Figure 3:
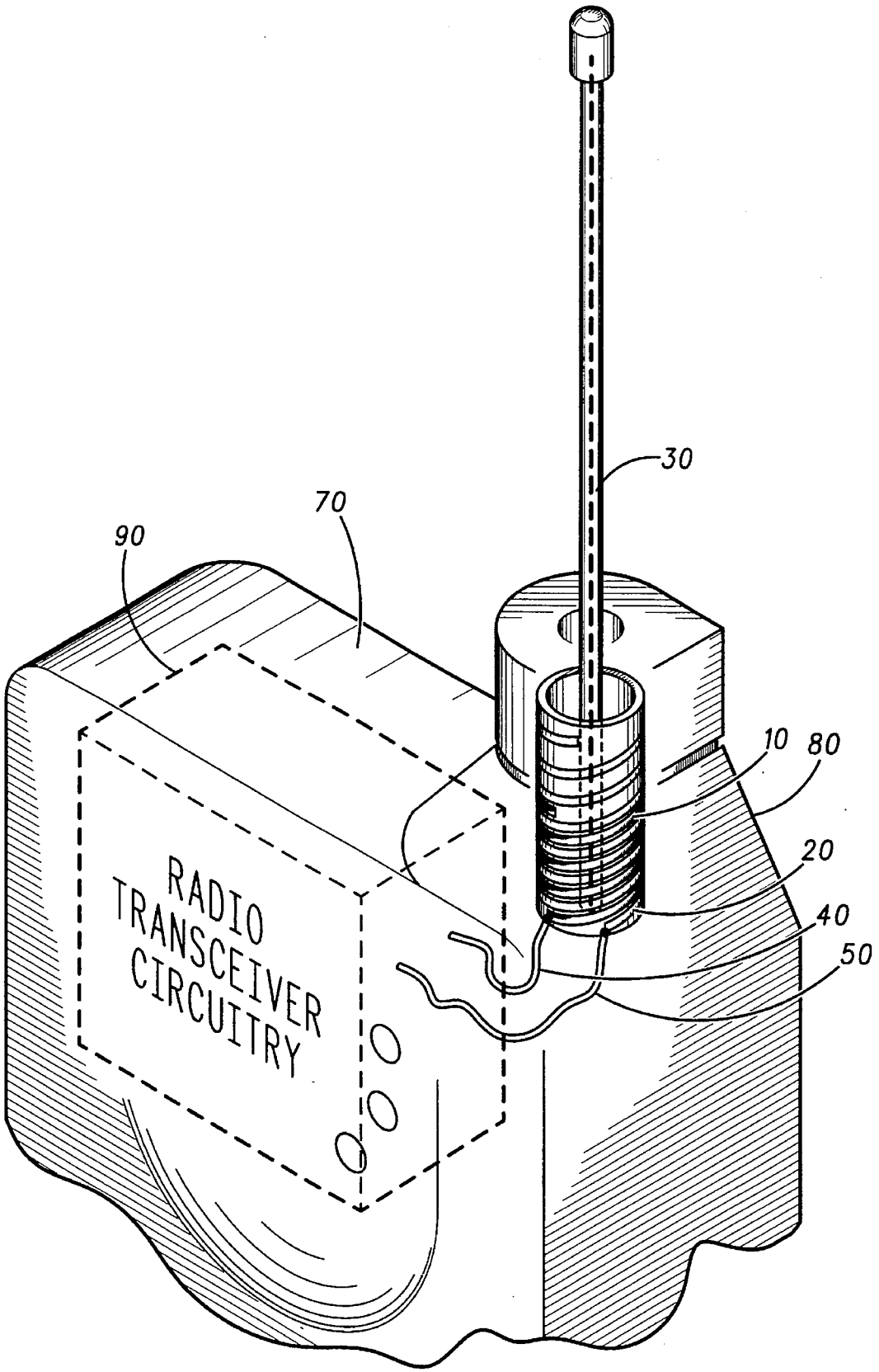
FIG. 3 illustrates a portable radio having a matched input antenna.

As illustrated by the side view of FIG. 1, two coils 10 and 20 of different dimension couple energy to an antenna element 30 according to the present invention. Coupling to the antenna element 30 using hot arm coil 10 and ground arm coil 20 allows for a matched input at hot feedline 40 and ground feedline 50. This input allows the antenna of the present invention to operate more energy efficiently. By coupling with these two coils, more energy is transferred to and from the antenna element 30.

The two coils of the hot arm coil 10 and the ground arm coil 20 also improve the antenna pattern characteristics by eliminating the flow of induced currents on the housing of a radio below the two coils. The two coils 10 and 20 cancel out the effects of energy traveling downward into a radio from the antenna element 30. A higher gain antenna is thus achieved for better communications while current drain on the battery of a portable radio is reduced. Increased signal quality and sound quality communications are achieved with smaller batteries capable of providing longer operation before recharging.

The two coils 10 and 20, in various embodiments of the present invention, can be wrapped around a cardboard or plastic cylinder 60. The two coils 10 and 20 are preferably flat copper microstrip conductors of roughly 0.05 millimeters (two thousandths of an inch) thick and roughly 1.778 millimeters (0.070 inches) wide. Alternatively, the two coils 10 and 20 could be freestanding in space or encapsulated within a plastic molding. The cylinder 60 preferably has as small as practical a diameter for compact realization and preferably has a diameter of less than one tenth of a wavelength of a signal to be transceived. For example, approximately a 8.128 millimeter (0.32 inches) diameter cylinder 60 is preferred for a signal to be transmitted at 920 megahertz (MHz). For proper operation, the cylinder 60 should at most have a diameter such that one turn of the coils has a circumference less than a wavelength of a signal to be transceived by the antenna.

Because the two coils are pitched to allow them to be twisted around the cylinder 60, the circumference of the cylinder 60 will be slightly smaller than the circumference of one turn of the coils. To achieve the matched input, one of the two coils 10 and 20 should be longer than the other coil. By providing one longer coil, an antenna input matched with the feedlines is achieved. This configuration has the added benefit of eliminating energy from being directed downward into a portable radio. Coils of a same length were found during experimentation to not achieve these objectives.

In a preferred embodiment, for an exemplary 920 MHz signal to be transceived, the ground arm coil 20 is preferably longer than the hot arm coil 10 by a ratio of 2.5 to 2. In the exemplary preferred embodiment, the cylinder 60 has the diameter of approximately 8.128 millimeters (0.32 inches) and the hot arm coil has a coiled axial length of approximately 20.955 millimeters (0.825 inches) and the ground arm coil 20 has a coiled axial length of approximately 30.099 millimeters (1.185 inches) and the coils 10 and 20 are pitched at roughly a 15 degree angle. Thus the hot arm coil has approximately 3.25 turns and the ground arm coil has approximately 5.5 turns.

The hot arm coil 10 and the ground arm coil 20 are configurable for different operating frequencies to be transceived by adjusting the length of the two coils or the respective ratio of the number of turns. Assuming the cylinder 60 is perfectly cylindrical and the pitch of the coils remains constant, the number of turns will be directly proportional to the length of each coil. In this perfectly cylindrical cylinder, the pitched coils will be helical coils. However, should the pitch of the coils vary or the cylinder 60 instead be conical or otherwise shaped, the number of turns will not be directly proportional to the length of each coil. Depending on configuration and operating frequency to be transceived for an application, the respective lengths of the two coils should be experimentally determined to achieve matching and efficient coupling.

For compactness to form a monopole or dipole in a portable radio, the antenna element is preferably coaxially disposed within the coils 10 and 20 for coupling thereto. For proper operation, however, the antenna element 30 does not need to be coaxially disposed within the two coils. Coupling is also achieved when the antenna element is disposed in proximity to the coils such as next to the coils. Antenna element 30 preferably consists of a single straight wire disposed within a plastic sheet or coating. The single straight wire of the antenna element 30 preferably extends downward adjacent to an entirety of the turns of the two coils 10 and 20. Because the antenna element 30 extends upward from a portable radio, only a portion such as the lower portion of the antenna element 30 preferably couples to the two coils 10 and 20.

The hot arm coil 10 and the ground arm coil 20 preferably are interleaved with one another as illustrated in FIG. 1. The hot arm coil 10 and the ground arm coil 20 could preferably be offset such that the shorter coil is not completely, or at all, interleaved with the longer of the coils.

FIG. 2 illustrates an end view of the antenna structure where the antenna element 30 is coaxially surrounded by the hot arm coil 10 and the ground arm coil 20. The cylinder 60 supports the two coils 10 and 20 with hot feedline 40 and ground feedline 50 at a lower portion thereof for connection to transmit or receive circuitry of a portable radio.

FIG. 3 illustrates a portable radio 70 such as a radiotelephone having increased antenna gain performance and energy efficiency using the hot arm coil 10 and the ground arm coil 20 in proximity to the antenna element 30. The hot feedline 40 and the ground feedline 50 of the two coils 10 and 20 connect to radio transceiver circuitry 90 of the portable radio 70. The two coils 10 and 20 are preferably disposed within a housing 80 of the portable radio 70 with the antenna element 30 extending therefrom. The antenna element 30 can coaxially slide into and out of the housing of the portable radio 70 for storage. However, when the antenna element is retracted, the two coils 10 and 20 would couple to a different portion of the antenna element for operation. The hot arm coil 10 and ground arm coil 20 may be placed coaxially with an antenna element 30 within a plastic housing of an antenna element. In such a configuration, the housing 80 of the antenna element could mechanically connect to the portable radio 70 at a pivot point.

Although the invention has been described and illustrated in the above description and drawings, it is understood that this description is by example only and that numerous changes and modifications can be made by those skilled in the art without departing from the true spirit and scope of the invention. For example, wire arrangements may be used to implement the two coils of the present invention. Further, these coils may be disposed in various alternate locations for coupling in proximity to an antenna element.

What is claimed:

1. An antenna structure having a matched input, comprising:

an antenna element having a straight portion;

a hot arm coil having an axis parallel to the straight portion of the antenna element disposed in sufficient proximity to the straight portion of the antenna element to cause electromagnetic coupling of a hot feedline to the antenna element; and a ground arm coil having an axis parallel to the straight portion of the antenna element disposed in sufficient proximity to the straight portion of the antenna element to cause electromagnetic coupling of a ground feedline to the antenna element and causing a matched input, wherein the hot arm coil and the ground arm coil are both electrically isolated from the antenna element and wherein the ground arm coil is electrically isolated from the hot arm coil.

2. An antenna structure according to claim 1, wherein the hot arm coil and the ground arm coil have different lengths.

3. An antenna structure according to claim 2, wherein respective lengths of the hot arm coil and the ground arm coil are sufficient to cause the antenna structure to be matched to an impedance of the hot and ground feedlines.

4. An antenna structure according to claim 3, wherein one turn of the hot arm coil and one turn of the ground arm coil each have a circumference less than a wavelength of a signal to be transceived by the antenna structure.

5. An antenna structure according to claim 4, wherein the ground arm coil has a larger number of turns than the hot arm coil.

6. An antenna structure according to claim 2, wherein the hot arm coil and the ground arm coil are interleaved with one another.

7. An antenna structure according to claim 2, wherein the antenna element comprises a straight wire.

8. An antenna element according to claim 1, wherein each of the hot arm coil and the ground arm coil is pitched and forms a helix.

9. An antenna structure according to claim 1, wherein the hot arm coil and the ground arm coil have a different number of turns.

10. An antenna structure according to claim 9, wherein a ratio of the number of turns of the hot arm coil and the ground arm coil is sufficient to cause the antenna structure to be matched to an impedance of the hot and ground feedlines.

11. An antenna structure according to claim 10, wherein one turn of the hot arm coil and one turn of the ground arm coil each have a circumference less than a wavelength of a signal to be transceived by the antenna structure.

12. An antenna structure according to claim 11, wherein the ground arm coil has a larger number of turns than the hot arm coil.

13. An antenna structure according to claim 1, wherein the hot arm coil and the ground arm coil are interleaved with one another.

14. A portable radio having an antenna with a matched input, comprising:

an antenna element having a straight portion;

a hot arm coil having an axis parallel to the straight portion of the antenna element disposed in sufficient proximity to the straight portion of the antenna element to cause electromagnetic coupling of a hot feedline to the antenna element;

a ground arm coil having an axis parallel to the straight portion of the antenna element disposed in sufficient proximity to the straight portion of the antenna element to cause electromagnetic coupling of a ground feedline to the antenna element and causing a matched input, wherein the hot arm coil and the ground arm coil are both electrically isolated from the antenna element and wherein the ground arm coil is electrically isolated from the hot arm coil; and radio transceiver circuitry operatively coupled to the hot feedline and the ground feedline.

15. A portable radio having an antenna structure with a matched input, comprising:

an antenna element mechanically coupled to a housing of the portable radio and having a straight portion;

a hot arm coil having an axis parallel to the straight portion of the antenna element disposed in sufficient proximity to the straight portion of the antenna element to cause electromagnetic coupling of a hot feedline to the antenna element;

a ground arm coil having an axis parallel to the straight portion of the antenna element disposed in sufficient proximity to the straight portion of the antenna element to cause electromagnetic coupling of a ground feedline to the antenna element, wherein the hot arm coil and the ground arm coil have different lengths sufficient to cause the antenna structure to be matched to an impedance of the hot and ground feedlines, wherein the hot arm coil and the ground arm coil are both electrically isolated from the antenna element and wherein the ground arm coil is electrically isolated from the hot arm coil; and radio transceiver circuitry operatively coupled to the hot feedline and the ground feedline.

* * * * *